US009168641B2

(12) United States Patent
Chen

(10) Patent No.: US 9,168,641 B2
(45) Date of Patent: Oct. 27, 2015

(54) BAR CLAMP WITH RATCHETS

(71) Applicant: Chung Li Chen, Taichung (TW)

(72) Inventor: Chung Li Chen, Taichung (TW)

( * ) Notice: Subject to any disclaimer, the term of this patent is extended or adjusted under 35 U.S.C. 154(b) by 109 days.

(21) Appl. No.: 14/217,540

(22) Filed: Mar. 18, 2014

(65) Prior Publication Data

US 2014/0284861 A1 Sep. 25, 2014

(30) Foreign Application Priority Data

Mar. 25, 2013 (TW) ..... 102205421 U

(51) Int. Cl.
*B25B 5/06* (2006.01)
*B25B 5/16* (2006.01)

(52) U.S. Cl.
CPC ..... *B25B 5/068* (2013.01); *B25B 5/163* (2013.01); *B25B 5/166* (2013.01)

(58) Field of Classification Search
CPC ..... B25B 1/02; B25B 1/20; B25B 5/02; B25B 5/067; B25B 5/068; B25B 5/101; B25B 5/125; B25B 5/163; B25B 5/166
USPC ..... 269/2, 6, 43, 45, 215, 216; 242/395; 24/68 A, 68 CD
See application file for complete search history.

(56) References Cited

U.S. PATENT DOCUMENTS 669,605 A * 3/1901 Vernon ..... B25B 1/08 269/157
1,220,639 A * 3/1917 Kakela ..... B25B 5/068 254/15
7,350,767 B2 * 4/2008 Huang ..... B60P 7/083 24/68 CD
7,530,556 B1 * 5/2009 Zheng ..... B25B 5/085 269/143
8,177,209 B2 * 5/2012 Chen ..... B25B 1/08 269/143
8,783,671 B2 * 7/2014 Ranieri ..... B25B 5/06 269/207
2008/0136077 A1 * 6/2008 Yang ..... B25B 5/127 269/6
2010/0181410 A1 * 7/2010 Ting ..... B60P 7/083 242/395
2015/0174737 A1 * 6/2015 Chen ..... B25B 5/085 269/6

* cited by examiner

*Primary Examiner* — Joshua Kennedy

(57) ABSTRACT

A clamp with a fixed jaw; a groove with the fixed jaw mounted thereon; a moveable jaw slidably mounted on the groove; a connecting member having one end secured to the moveable jaw and including a hollow cylinder at an other end disposed in the fixed jaw, and a strap interconnecting the cylindrical element and the hollow cylinder; a gear including a plurality of teeth disposed on the fixed jaw; a biasing member disposed on the fixed jaw opposite to the gear; a bifurcated handle put on the fixed jaw to cover both the gear and the biasing member; a first pawl in the handle; a lever secured to the first pawl; a rotatable pin with the hollow cylinder fastened thereon, the pin being for fastening the handle, the biasing member, the fixed jaw, the hollow cylinder, and the gear together; and the second pawl in the fixed jaw.

1 Claim, 7 Drawing Sheets

BAR CLAMP WITH RATCHETS

BACKGROUND OF THE INVENTION

1. Field of the Invention

The invention relates to hand tools and more particularly to a bar clamp having two ratchets.

2. Description of Related Art

A conventional ratchet clamp comprising a first limb including a first handle and a first jaw; a second limb including a second handle and a second jaw; a common pivotal bearing for the relative pivotal movement of the first and second limbs; and a ratchet mechanism for fixing relative pivotal positions of the first and second limbs; and a slide rail arranged on the first handle, the first jaw being guided on the slide rail in a displaceable manner.

Notwithstanding the conventional ratchet clamp, the invention is neither taught nor rendered obvious thereby.

SUMMARY OF THE INVENTION

It is therefore one object of the invention to provide a clamp comprising a fixed jaw including a slit; a groove having one end with the fixed jaw mounted thereon; a moveable jaw slidably mounted on the groove and including a transverse trough; a connecting member including a cylindrical element at one end disposed in the trough to secure to the moveable jaw, a hollow cylinder at an other end disposed in the fixed jaw, and a strap interconnecting the cylindrical element and the hollow cylinder by passing through the slit; a gear including a plurality of teeth disposed on the fixed jaw; a biasing member disposed on the fixed jaw opposite to the gear; a bifurcated handle put on the fixed jaw to cover both the gear and the biasing member; a spring biased first pawl disposed in the handle; a lever secured to the first pawl; a rotatable pin with the hollow cylinder fastened thereon, the pin being for fastening the handle, the biasing member, the fixed jaw, the hollow cylinder, and the gear together; and a spring biased second pawl disposed in the fixed jaw; wherein in an inoperative position, both the first and second pawls engage the teeth to lock the connecting member; wherein a clockwise rotation of the lever disengages the first pawl from the teeth, and a clockwise rotation of the second pawl disengages the second pawl from the teeth, thereby unlocking the connecting member, clockwise rotating the pin to clockwise twist the biasing member, and allowing the moveable jaw to move along the groove; wherein a release on the lever causes the first pawl to engage the teeth and causes the second pawl to engage the teeth respectively; wherein a counterclockwise rotation of the handle allows the second paw to rotate the gear about the pin, thereby winding the connecting member to move the moveable jaw toward the fixed jaw.

The above and other objects, features and advantages of the invention will become apparent from the following detailed description taken with the accompanying drawings.

DETAILED DESCRIPTION OF THE INVENTION

Figure 1:
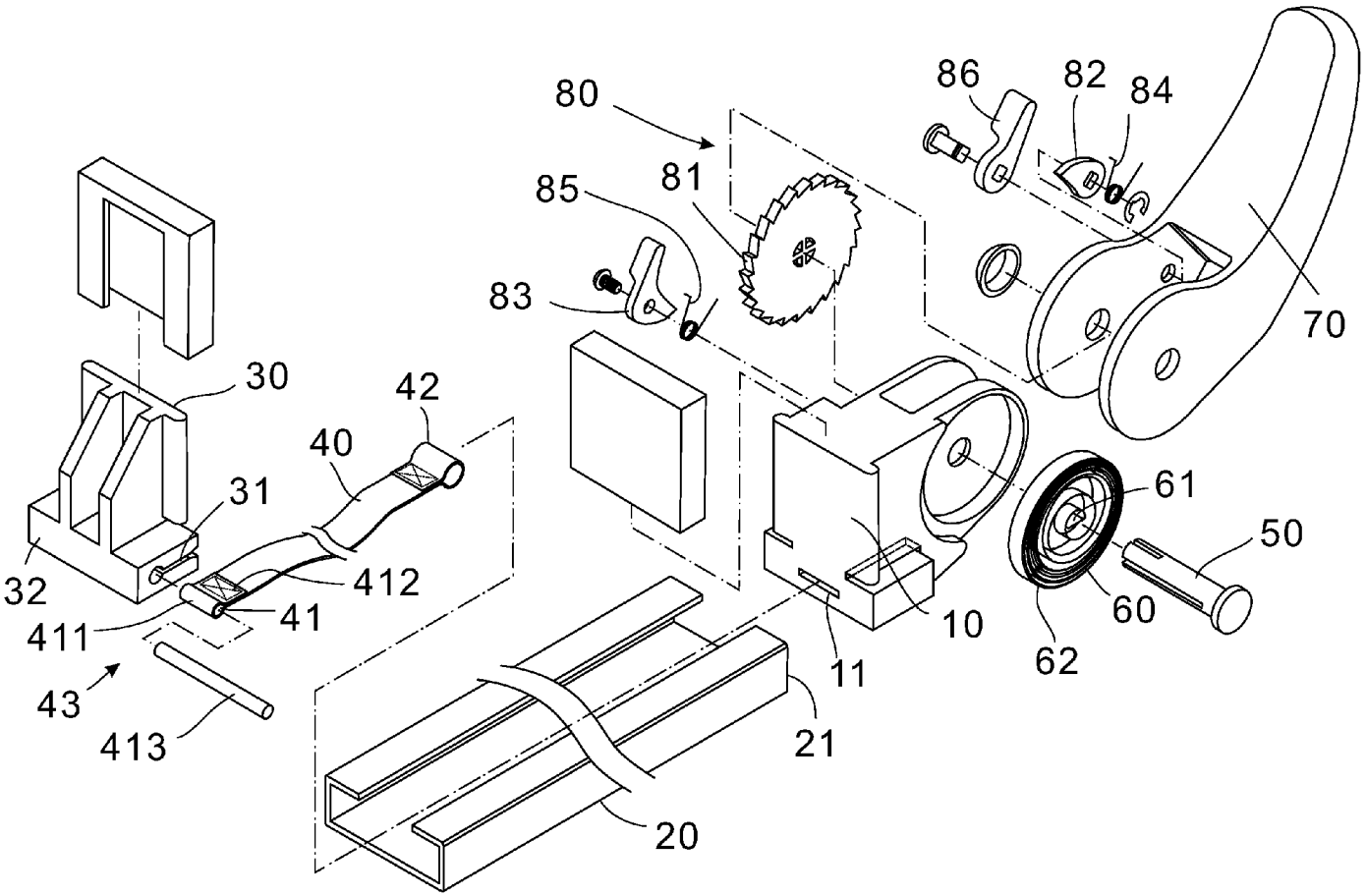
FIG. 1 is an exploded view of a bar clamp according to the invention.
Figure 2:
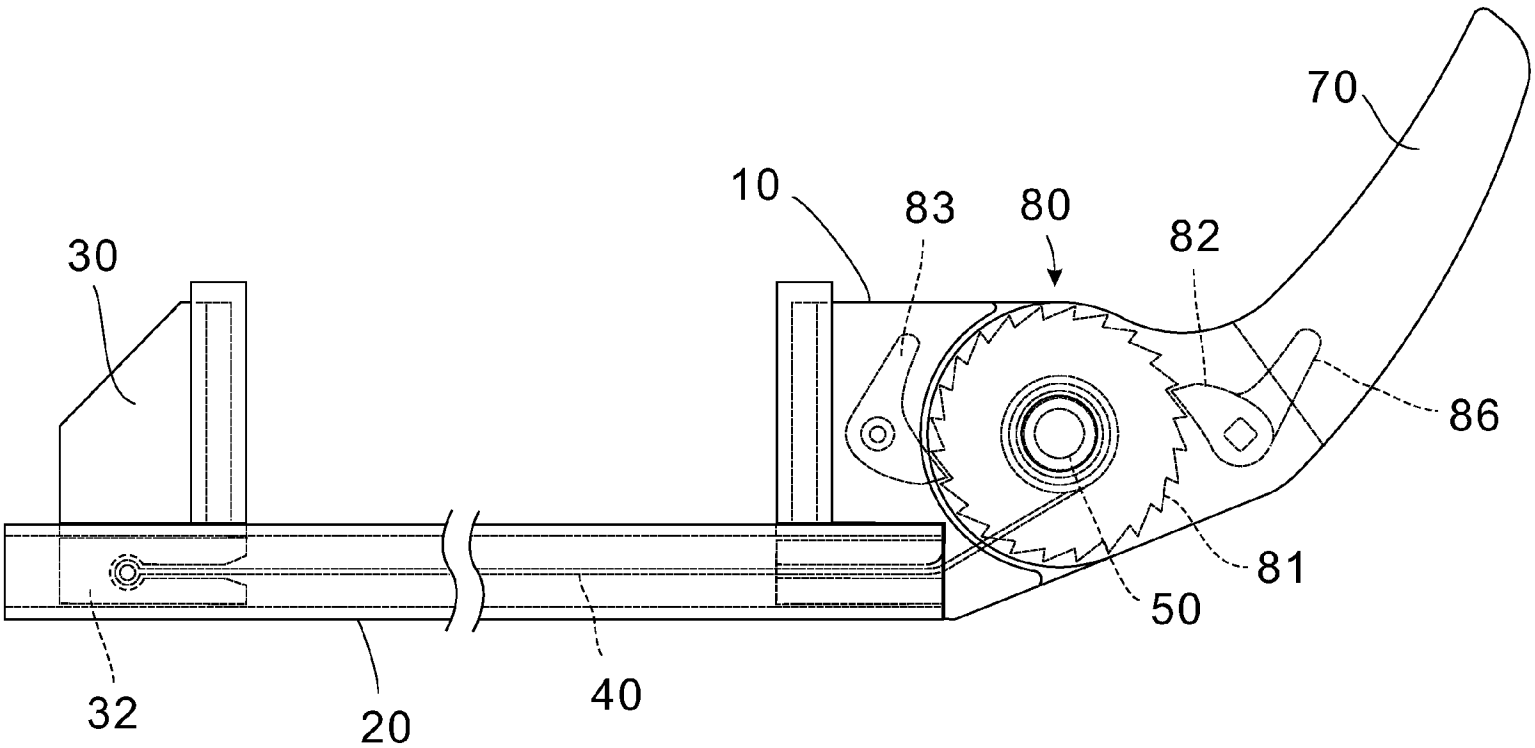
FIG. 2 is a side elevation of the assembled bar clamp.
Figure 3:
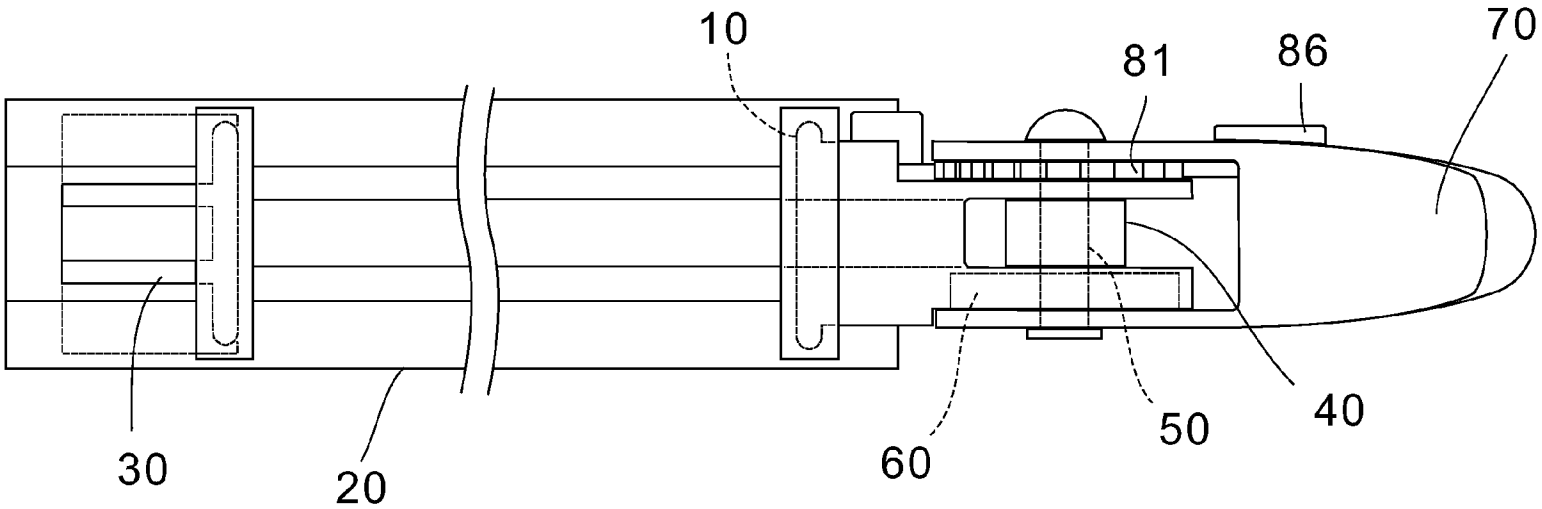
FIG. 3 is a top plan view of the bar clamp of FIG. 2.

Referring to FIGS. 1 to 7, a bar clamp with ratchets in accordance with the invention comprises the following components as discussed in detail below.

A fixed jaw 10 includes a slit 11. A groove 20 has a rectangular section and includes one end 21 with the fixed jaw 10 securely mounted thereon. A moveable jaw 30 is slidably mounted on the groove 20 and includes a base 32 and a transverse trough 3 through the base 32. A connecting member 40 includes a hollow first cylinder 411 at one end 41 and disposed in the trough 3, a hollow second cylinder 42 at the other end, a strap 412 interconnecting one end 41 and the second cylinder 42, and a cylindrical rod 413 inserted into the first cylinder 411 to form a fastening device 43 for securing one end 41 to the moveable jaw 30. The strap 412 passes through the groove 20 and the slit 11 so that the second cylinder 42 may be disposed in the fixed jaw 10.

A round gear 80 has a plurality of teeth 81 and is disposed on the fixed jaw 10. A spiral torsion spring 60 is disposed on the fixed jaw 10 opposite to the gear 80. A bifurcated handle 70 is put on the fixed jaw 10 to cover both the gear 80 and the torsion spring 60. A first pawl 82 is disposed in the handle 70 by means of a coil spring 84. A lever 86 is secured to the first pawl 82 so that the lever 86 and the first pawl 82 can co-rotate. A pin 50 is inserted through the handle 70, the torsion spring 60, the fixed jaw 10, the second cylinder 42, and the gear 80 to hold them in place. One end 61 of the torsion spring 60 is secured to the pin 50 and the other end 62 thereof is secured to the fixed jaw 10. A second pawl 83 is pivotably disposed in the fixed jaw 10 by means of a coil spring 85. In an inoperative position, both the first and second pawls 82, 83 engage the teeth 81.

Figure 4:
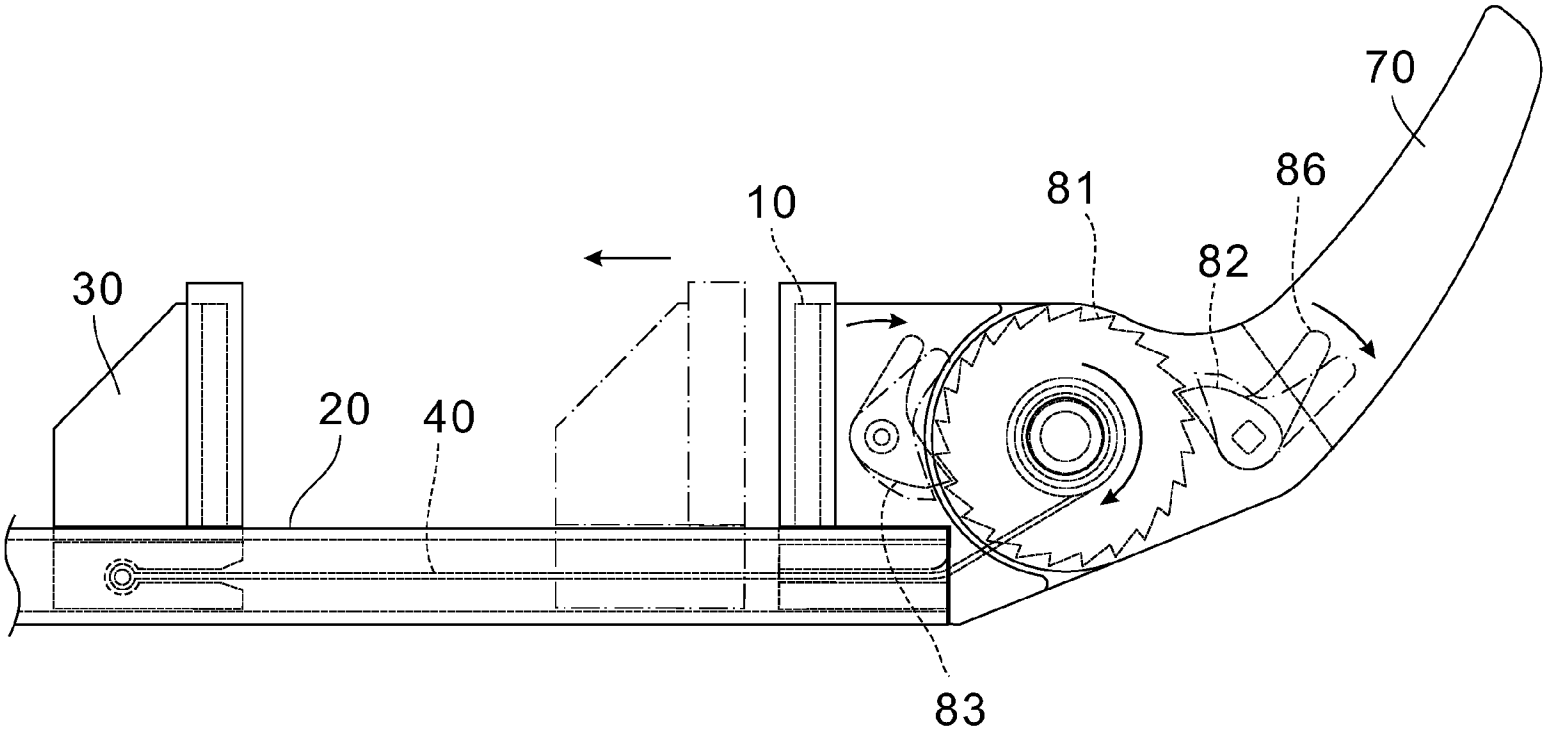
FIG. 4 is a view similar to FIG. 2 showing an operation for opening the jaws.

Operations of the invention are described in detail below. As shown in FIG. 4, a person may use one hand to clockwise rotate the lever 86 (i.e., the first pawl 82) to disengage the first pawl 82 from the teeth 81 and use the other hand to clockwise rotate the second pawl 83 to disengage the second pawl 83 from the teeth 81. Thus, the connecting member 40 is unlocked and the moveable jaw 30 is free to move away from the fixed jaw 10 along the groove 20. Further, the pin 50 clockwise rotates and the torsion spring 60 is twisted clockwise to store energy.

Figure 6:
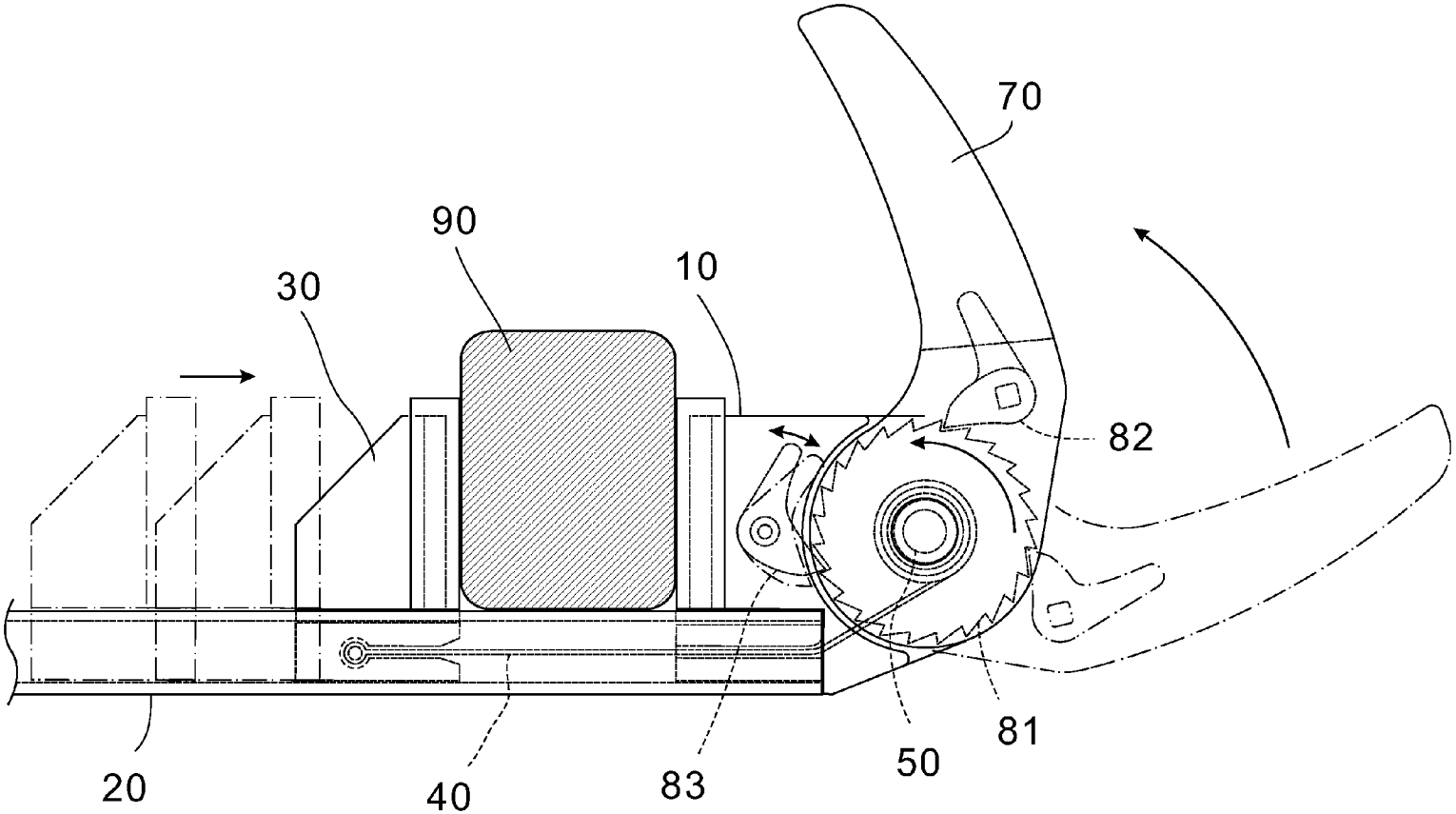
FIG. 6 is a view similar to FIG. 2 showing a counterclockwise turning of the handle for pulling the moveable jaw toward the work piece.

As shown in FIG. 6, a release of the hands on the lever 86 and the second pawl 83 causes the first pawl 82 to engage the teeth 81 and causes the second pawl 83 to engage the teeth 81 respectively. A work piece 90 is then placed on the groove 20 between the fixed jaw 10 and the moveable jaw 30. The person may counterclockwise rotate the handle 70 so that each of the first pawl 82 and the second pawl 83 easily slide up and over the gently sloped edges of the teeth 81 and fall into the depression between the teeth 81 as it passes the tip of each tooth 81. Also, the pin 50 counterclockwise rotates and the torsion spring 60 is loosened counterclockwise to pull the moveable jaw 30 toward the fixed jaw 10 by means of the connecting member 40. Thus, the moveable jaw 30 moves a step toward the work piece 90. When the teeth 81 rotate clockwise, the second pawl 83 will catch against the steeply sloped edge of the first tooth 81 it encounters, thereby locking it against the tooth 81 and preventing any further clockwise motion.

Figure 5:
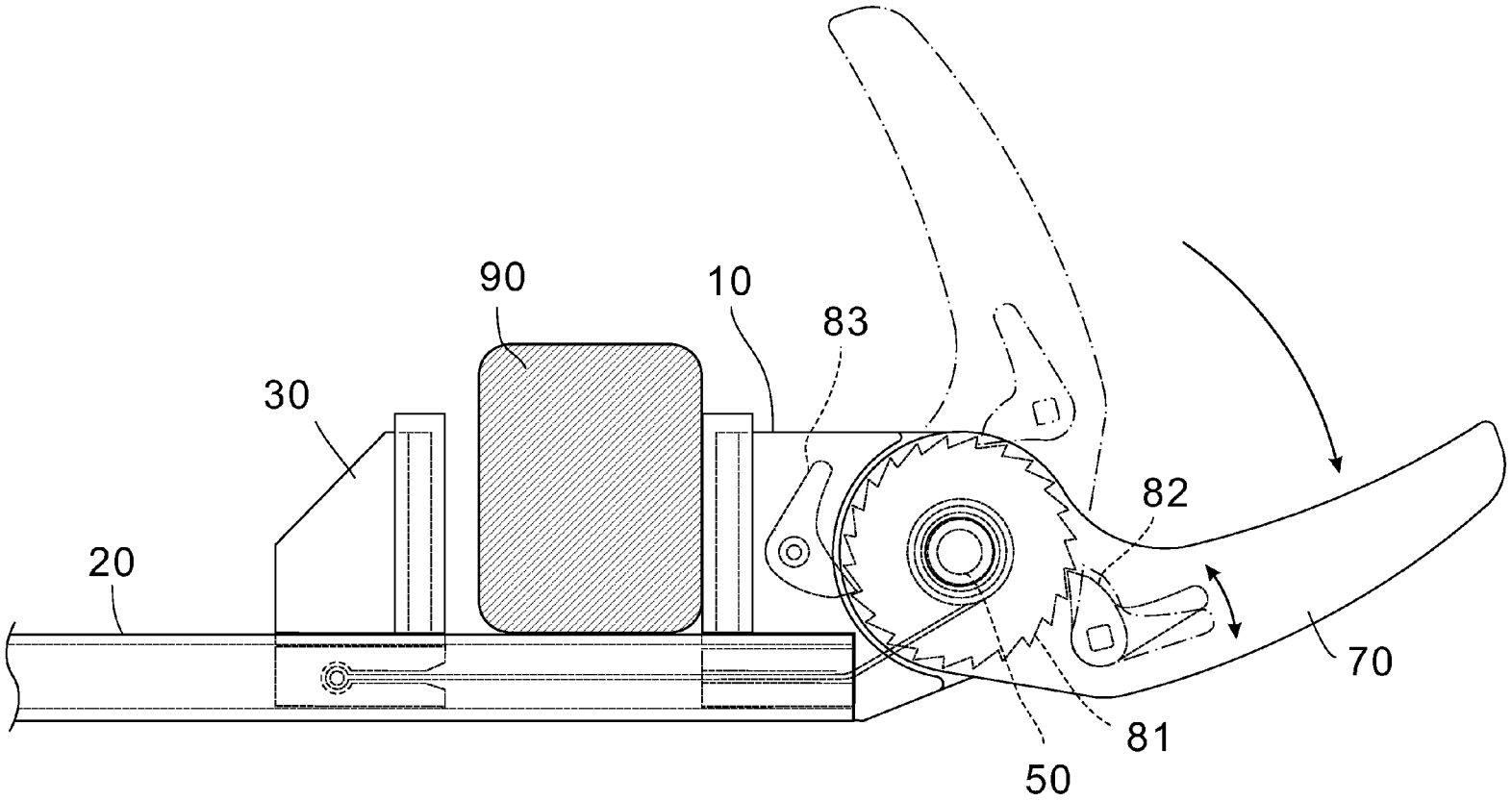
FIG. 5 is a view similar to FIG. 2 showing a clockwise turning of the handle.

As shown in FIG. 5, the person may clockwise rotate the handle 70 so that each of the first pawl 82 and the second pawl 83 easily slide up and over the gently sloped edges of the teeth 81 and fall into the depression between the teeth 81 as it passes the tip of each tooth 81.

The person may successively alternately perform the steps discussed with respect to FIG. 6 and FIG. 5 until the work piece 90 is clamped by the moveable jaw 30 and the fixed jaw 10.

Figure 7:
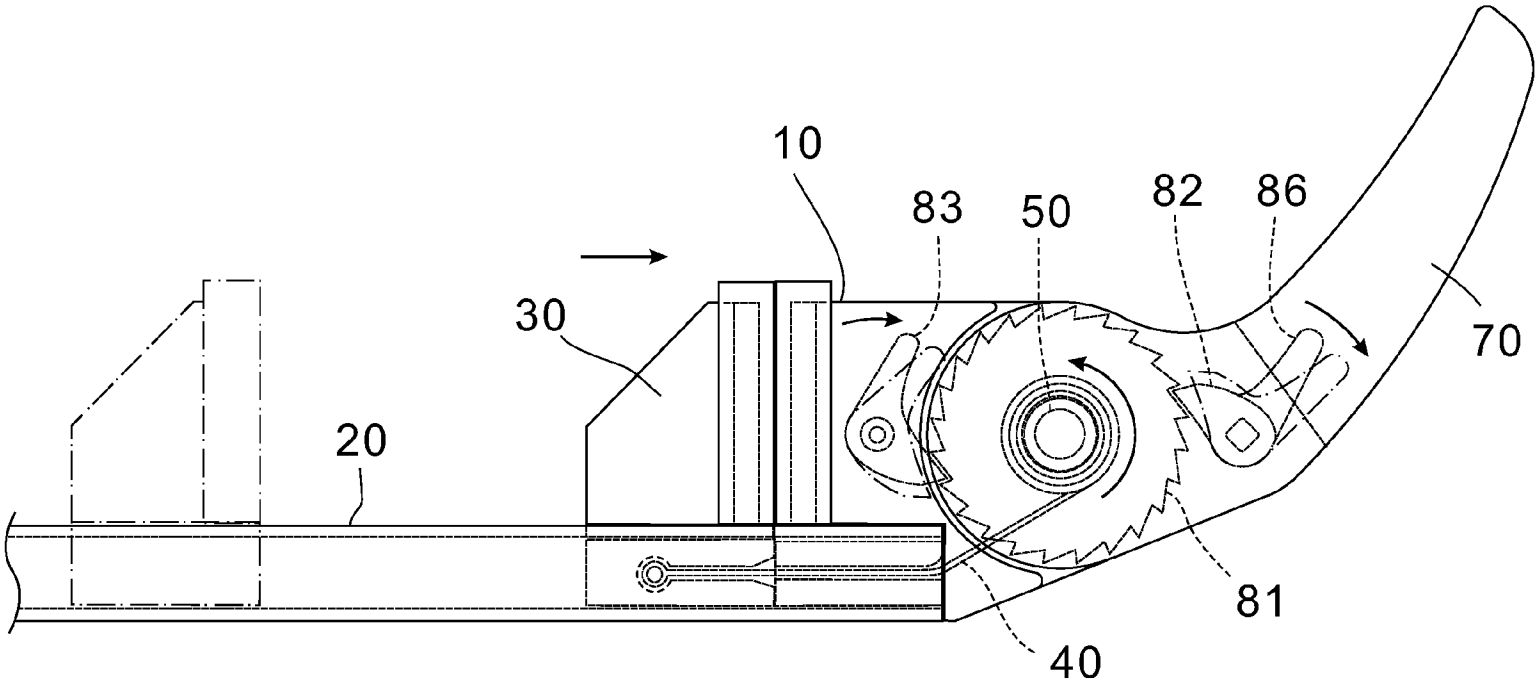
FIG. 7 is a view similar to FIG. 2 showing a clockwise turning of the lever to engage the moveable jaw with the fixed jaw by pulling the connecting member.

As shown in FIG. 7, the person may use one hand to clockwise rotate the lever 86 (i.e., the first pawl 82) to disengage the first pawl 82 from the teeth 81 and use the other hand to clockwise rotate the second pawl 83 to disengage the second pawl 83 from the teeth 81. Thus, the energized torsion spring 60 may counterclockwise rotate the pin 50 to wind the connecting member 40, thereby pulling the moveable jaw 30 toward the fixed jaw 10 until the moveable jaw 30 engages the fixed jaw 10.

While the invention has been described in terms of preferred embodiments, those skilled in the art will recognize that the invention can be practiced with modifications within the spirit and scope of the appended claims.

What is claimed is:

1. A clamp comprising:

a fixed jaw including a slit;

a groove having one end with the fixed jaw mounted thereon;

a moveable jaw slidably mounted on the groove and including a transverse trough;

a connecting member including a cylindrical element at one end disposed in the trough to secure to the moveable jaw, a hollow cylinder at an other end disposed in the fixed jaw, and a strap interconnecting the cylindrical element and the hollow cylinder by passing through the slit;

a gear including a plurality of teeth disposed on the fixed jaw;

a biasing member disposed on the fixed jaw opposite to the gear;

a bifurcated handle put on the fixed jaw to cover both the gear and the biasing member;

a spring biased first pawl pivotably disposed in the handle;

a lever secured to the first pawl;

a rotatable pin with the hollow cylinder fastened thereon, the pin being for fastening the handle, the biasing member, the fixed jaw, the hollow cylinder, and the gear together; and a spring biased second pawl pivotably disposed in the fixed jaw;

wherein in an inoperative position, both the first and second pawls engage the teeth to lock the connecting member;

wherein a clockwise rotation of the lever disengages the first pawl from the teeth, and a clockwise rotation of the second pawl disengages the second pawl from the teeth, thereby unlocking the connecting member, clockwise rotating the pin to clockwise twist the biasing member, and allowing the moveable jaw to move along the groove;

wherein a release on the lever causes the first pawl to engage the teeth and causes the second pawl to engage the teeth respectively; and wherein a counterclockwise rotation of the handle allows the second pawl to rotate the gear about the pin, thereby winding the connecting member to move the moveable jaw toward the fixed jaw.

* * * * *